US005275102A

United States Patent [19]

Prittie

[11] Patent Number: 5,275,102

[45] Date of Patent: * Jan. 4, 1994

[54] RAISED IMAGE PLATE CONSTRUCTION WITH REGIONS OF VARYING STIFFNESS IN THE IMAGE AREAS

[76] Inventor: Allan R. Prittie, 46 Edenbrook Hill, Islington, Ontario, Canada

[ * ] Notice: The portion of the term of this patent subsequent to Dec. 24, 2008 has been disclaimed.

[21] Appl. No.: 788,316

[22] Filed: Nov. 5, 1991

[30] Foreign Application Priority Data

Dec. 21, 1988 [GB] United Kingdom ..... 8829802

Related U.S. Application Data

[63] Continuation-in-part of Ser. No. 436,037, Nov. 14, 1989, Pat. No. 5,074,209.

[51] Int. Cl.[5] ..... B41L 38/00; B41M 9/04

[52] U.S. Cl. ..... 101/395; 101/401.3

[58] Field of Search ..... 101/401.3, 395

[56] References Cited

U.S. PATENT DOCUMENTS

| | | | |
|---|---|---|---|
| 2,133,981 | 10/1938 | Frazier | 101/401.3 X |
| 2,825,282 | 3/1958 | Gergen et al. | 101/401.3 X |
| 3,085,507 | 4/1963 | Kunetka | 101/395 X |
| 3,102,030 | 8/1963 | Hoerner | 101/401.3 X |
| 3,103,168 | 9/1963 | Braznell et al. | 101/401.3 X |
| 3,137,633 | 6/1964 | Kline | 522/6 X |
| 3,169,066 | 2/1965 | Hoerner | 430/309 |
| 3,213,789 | 10/1965 | McIlvaney et al. | 101/401.3 |
| 3,347,162 | 10/1967 | Braznell et al. | 101/395 X |
| 3,391,637 | 7/1968 | Reynolds et al. | 101/401.3 |
| 3,549,366 | 12/1970 | Margerum | 430/328 X |
| 3,703,362 | 11/1972 | Dustin | 101/401.3 X |
| 3,779,761 | 12/1973 | Dustin | 101/401.3 X |
| 3,798,035 | 3/1974 | Varga et al. | 430/306 |
| 3,874,376 | 4/1975 | Dart et al. | 522/7 X |
| 4,078,494 | 3/1978 | Gregory | 101/401.3 X |
| 4,557,994 | 12/1985 | Nagano et al. | 430/155 X |
| 4,790,919 | 12/1988 | Baylor, Jr. | 430/296 X |
| 5,074,209 | 12/1991 | Prittie | 101/395 |

*Primary Examiner*—Edgar S. Burr
*Assistant Examiner*—Stephen R. Funk
*Attorney, Agent, or Firm*—Shoemaker and Mattare

[57] ABSTRACT

In a raised-image printing process, a plate construction includes a plate portion with an upper printing surface for printing an image on a substrate, the image including areas of greater ink coverage and areas of lesser ink coverage. Regions of greater and lesser stiffness are incorporated in the construction such that greater stiffness occurs under image areas of greater ink coverage, and lesser stiffness occurs under areas of lesser ink coverage.

5 Claims, 2 Drawing Sheets

RAISED IMAGE PLATE CONSTRUCTION WITH REGIONS OF VARYING STIFFNESS IN THE IMAGE AREAS

This is a continuation-in-part of U.S. application Ser. No. 4 36, 037, filed on Nov. 14, 1989, "Improved Raised Image Plate Construction and Method", now U.S. Pat. No. 5,074,209.

This invention relates generally to the printing industry, and has to do particularly with an improved construction for a printing plate of relatively low stiffness, or its support, used in the raised plate method of printing (sometimes referred to as the flexographic and/or as the letterpress process).

BACKGROUND OF THIS INVENTION

In accordance with the general terminology utilized in the printing industry, the word "letterpress" refers to a printing procedure in which the locations on the printing plate where ink is to be deposited are raised with respect to areas where ink is not to be deposited. Within the general designation of letterpress printing, two distinguishable forms can be identified. The first typically utilizes a relatively stiff printing plate (i.e. employing a material of relatively high stiffness), commonly referred to in the industry as a "hard" plate. "Hard" plate letterpress systems typically employ an impression roll with a compliant coating and one or more form cylinder(s) also with compliant coating(s). The form cylinder may be either directly inked from a well, or remotely inked through a series of rollers. The ink on the form cylinder is transferred to the inking locations on the "hard" plate which is mounted to the plate cylinder. The web or sheet of substrate to be printed is entrained between the impression cylinder and the plate cylinder. With a "hard" plate, the impression cylinder must be relatively less stiff, in order to avoid damage due to mechanical interference, and/or to improve the evenness of ink transfer from the printing plate to the substrate to be printed.

In this specification, the quality of "stiffness" means the resistance of a material to deformation under a given force. For example, if equal thicknesses of two different materials were placed on a hard surface, and a given weight over a given area were impressed upon each of the materials in order to deform or "pinch" the material, the material with the greater stiffness would yield less than the material with the lesser stiffness.

The second letterpress category utilizes a printing plate (commonly referred to in the industry as a "soft" plate) whose stiffness is relatively lower, i.e. the raised areas which are to be inked and then transfer the ink to the substrate are relatively less stiff with respect to the relatively more stiff form cylinder(s) and relatively more stiff impression roll (frequently steel).

The term "flexographic" is often utilized to refer to the second letterpress system described immediately above, in which a less stiff plate is used e other two rollers being relatively more stiff.

In the raised plate printing method the printing plates are normally made with as uniform a total thickness as is possible.

The printing industry generally recognizes certain inherent problems relating to the raised plate printing method using a soft plate of uniform resilience. One of these problems relates to the degree to which the printing surface of the plate is urged against the substrate, depending upon the area of coverage of the ink. It is known that the degree to which a plate surface is urged against the substrate is preferably less for the less covered areas, and more for the more covered areas. The "urging" comes about due to the squeezing or pinching of the soft plate between the substrate and the plate cylinder. When the area less covered includes tiny dots due to the four-colour separation process, the dots are printed by an upstanding cone having on top a flat portion which accepts ink and prints the dot. It is found generally that the amount of plate squeezing necessary to properly print solid-ink areas is too great to allow correct printing of the dotted areas, because the conical support below the inked surface creates excessive contact pressure which in turn tends to expel ink from the space between the paper and the raised dot on the plate, thus forming a ring or doughnut of solid ink around a central zone of inadequate ink coverage. On the other hand, if the degree of squeezing between the plate and the impression roll is reduced to a level which allows a good printing of the dot, it is found that areas of solid ink are inadequately printed, i.e. the ink is not fully and/or properly transferred to the substrate.

It is known to provide, for use with a printing plate, a "make ready" plate which corresponds to the plate in the sense that the "make ready" plate has an increased thickness in the regions corresponding to the more solid ink printing, and a gradually decreasing thickness in proportion to the degree of ink coverage in other regions of the plate. Areas of low ink coverage will include locations where fine copy appears. The "make ready" is positioned under the plate with corresponding areas matched, so that all solid regions will tend to be urged more strongly against the substrate (i.e., squeezed more) than are the areas which are only partially ink covered. It is understood that this process works to some extent, but not fully. It involves considerable extra expense to fabricate the "make ready" sheet, and it complicates the process of affixing the plate to the plate cylinder.

Relative to the affixing of the plate to the plate cylinder, where a plate of relatively low stiffness is utilized without the "make ready plate", it is typical in the industry to use a sheet of two-sided adhesive tape between the plate and the cylinder. Such tape may be very compliant (referred to in the trade as "cushion tape"), incorporating a layer of open or closed cell foam which is usually very low in stiffness. It is also known to use relatively stiff or non-compliant tape. It has been found that, when a low-stiffness tape is used to secure the plate to the plate cylinder, the plate-to-substrate contact pressure drops off too greatly in the locations of high ink coverage (area-wise), while the contact pressure between plate and substrate in the locations of relatively low ink coverage (area-wise) tends to allow more acceptable printing as the dots become smaller. The low-ink coverage areas are referred to as the highlight areas of the four colour printing process. Conversely, when a stiff tape is used, the dot areas extrude ink outwardly to a larger diameter than originally intended, and the locations of heavy ink coverage (area-wise) usually print relatively properly.

Among the prior art known to the applicant, U.S. Pat. 3,103,168, issued Sep. 10, 1963 to Braznell et al, exemplifies the difficulties encountered when using a plate component with a varying thickness. Because of this variation in thickness, it tends to be difficult if not impossible to ensure that the plate achieves a proper "fit" around the cylinder. In the four-colour separation process, each combination of printing plate and make-ready, as taught by Braznell et al, will have a different configuration, with the raised parts varying in height (thickness) between the different colors. For example, if the picture to be reproduced has a lot of yellow, the yellow plate would be effectively thickened up substantially compared to the plate for a colour which is less in evidence than the yellow. This would certainly mean that the four printings would likely fail to coincide or "fit" together. Another problem is that of "register", which has to do with keeping the web at the right "repeat length" with respect to the plate cylinder. What happens is that, because the plate (the upper surface of the plate) is digging into the web, and into the impression roll if it is a soft one, the web is actually driven by the plate, particularly where the thickness of the plate is excessive. Thus the web can be (and very frequently is) forced out of proper registry by overly thick plate regions.

Another patent of some interest is U.S. Pat. No. 3,169,066, issued Feb. 9, 1965 to Hoerner. Hoerner describes a process for sensitizing a polymeric body such that exposure to light, through either a positive or negative of a picture, initiates either a selective softening process (to create areas that can be abraded away) or a hardening process (wherein the non-exposed areas can be abraded away). In particular, Hoerner describes the possibility of using transparent blocks for making a printing plate, the transparent blocks allowing the light to pass directly through from one surface to the other, thus producing a reverse image on the bottom surface. Hoerner refers to this bottom image briefly as a "make-ready". However, in actual fact Hoerner does not change the stiffness of the various regions or columns affected by the light, in such a way as to vary the stiffness per unit printing area. In other words, even though Horner provides, for each "cone" to print a dot of colour, a reverse "cone" on the other surface, the column of plastic between the upper conical shape and the lower conical shape is not stiffer or less stiff than the plastic material occupying a similar cylinder in a solid-ink region.

One of the prerequisites for the carrying out of the present invention is a polymer which, upon exposure to suitable radiation (such as light), will undergo graduated hardening or graduated softening. A patent of interest in this area is U.S. Pat No. 3,549,366, issued Dec. 22, 1970 to Margerum, the specification of which is hereby incorporated by reference. The Margerum patent discloses a method of effecting optical hardening of photosensitized acrylamide compositions. The patentee indicates that the images are initially illuminated and projected or cast upon the prepared photosensitive acrylamide composition by visible radiation, this being followed by uniform illumination of the composition with visible light, and subsequent uniform ultraviolet radiation hardening.

Another patent of interest is U.S. Pat. No. 3,137,633, issued Jun. 16, 1964 to Kline. Kline discloses the discovery that the density of cross-linking in polyethylene or silicones depends to some extent on the energy absorbed per gram. The disclosure of this patent is hereby incorporated by reference.

Yet another patent of interest is U.S. Pat. No. 4,790,919, issued Dec. 13, 1988 to Baylor, Jr. Although directed to the preparation of electrophoresis gel material, the patent does discuss the photoinitiation of polymerization, and further discusses varying the intensity of light in order to adjust the degree of polymerization. The disclosure of this patent is hereby incorporated herein by reference.

A further patent of interest is U.S. Pat. No. 4,557,994, issued Dec. 10, 1985 to Nagano et al, the specification of which hereby incorporated herein by reference. This patent discloses a printing plate which is light-sensitive, and lists a number of suitable materials.

A still further patent of interest is U.S. 3,798,035, issued Mar. 19, 1974 to Varga et al, the disclosure of which is hereby incorporated herein by reference. Varga et al teach that the extent of crosslinking in a photopolymer is dependent on the combination of intensity and duration of radiation. This is inferred from the admission that the extent of cross-linking diminishes as depth from the exposed surface increases, and it is clear that the intensity of the radiation would decrease with increasing distance from the exposed surface.

A further patent of interest is U.S. Pat. No. 3,874,376, issued Apr. 1, 1975 to Dart et al, the disclosure of which is hereby incorporated herein by reference. Dart et al indicate that the degree of polymerization of a photopolymer depends upon the intensity of the visible light used.

In view of the foregoing discussion, it is an object of one aspect of this invention to facilitate optimum printing with a raised plate without having to vary the distance from the printing surface to the plate cylinder, wherein the urging of the plate surface against the substrate under the more solidly inked areas of the plate is greater than under the partially inked areas. Preferably, the urging varies continuously such that it is roughly proportional to the degree of ink coverage. Alternatively, the variation may be in discrete steps, again roughly proportional to the degree of ink coverage.

More particularly, this invention provides, for use in a raised image printing process employing a plate support, an improved plate construction comprising:

a flexible plate portion having an upper printing surface for printing an image on a substrate, the image including areas of greater ink coverage and areas of lesser ink coverage, and means incorporated integrally into the plate portion for providing graduated regions of greater and less resistance to deformation below said upper printing surface, said means affecting the degree to which the surface is urged against the substrate with greater resistance to deformation occurring under image areas of greater ink coverage, and lesser resistance to deformation occurring under areas of lesser ink coverage, the plate portion having a uniform thickness, whereby said upper printing surface is uniformly spaced above the plate support.

Additionally, this invention provides a method of printing using a raised image printing process, the method comprising the steps:

providing a support surface;

providing a plate portion which has an upper printing surface for printing an image;

providing a support surface;

providing a plate portion which has an upper printing surface for printing an image;

securing said plate portion to said support surface such that said upper printing surface is at a uniform spacing from said support surface;

providing graduated regions of differing resistance to deformation integrally within said plate portion without altering said uniform spacing, such that a greater degree of resistance to deformation is provided under image areas of greater ink coverage, and a lesser degree of resistance to deformation is provided under image areas of less ink coverage; and printing an image utilizing said upper printing surface.

GENERAL DESCRIPTION OF THE DRAWINGS

Four embodiments of this invention are illustrated in the accompanying drawings, in which.

DETAILED DESCRIPTION OF THE DRAWINGS

Figure 1:
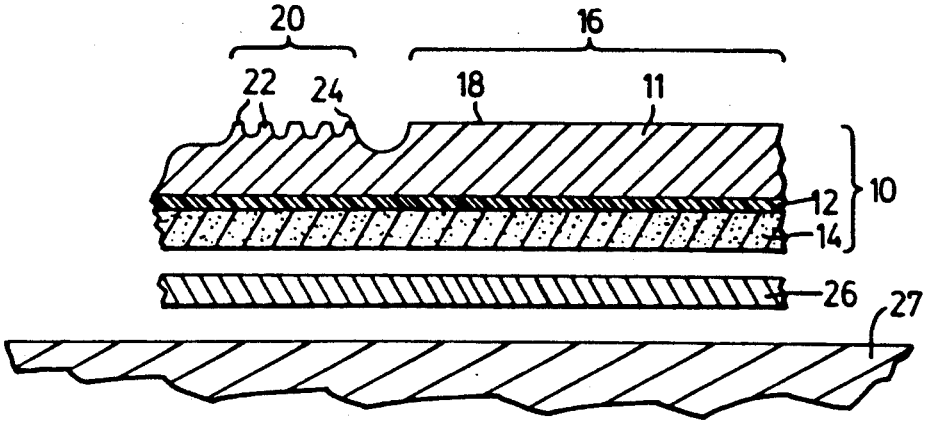
FIG. 1 is a sectional view through a first embodiment of this invention.

The first embodiment of this invention, illustrated in FIG. 1, has the form of a composite member 10 which incorporates a plate portion 11 which is bonded to a flexible but relatively non-stretchable layer 12, typically of polyester. Bonded to the underside of the layer 12 is a further layer 14 having controlled regions of different stiffness. In FIG. 1, the stippled region of the layer 14 represents a greater degree of stiffness than the non-stippled area. FIG. 1 shows a first region 16 which has an uninterrupted upper surface 18, which is intended to print a solid colour. Another region identified by the numeral 20 consists of individual cones or "spikes" 22 having flat circular tops 24, which are intended to print the colored dots utilized in the four-colour process printing technique. It will be seen that the layer 14 is not stippled under the region 20. Thus, the layer 14 is relatively stiff in the stippled area under the region 16 of the plate portion 11, whereas it is less stiff under the region 20.

FIG. 1 also illustrates a piece of tape 26 (having adhesive on both sides) which would typically be a relatively stiff material functioning only to adhere the plate support 27 (for example a cylinder) to the multi-layer composite member 10 consisting of layers 11, 12 and 14.

It will thus be understood that, when the plate printing portion 11 and the connected layers 12 and 14 are adhered or otherwise affixed to a plate support with the double-sided tape 26, the region identified by the numeral 20 will not be urged as strongly against the substrate as the region identified by the numeral 16 (the word "substrate" used herein refers to the paper or web being printed).

The layer 14 could be made of a material selected on the basis of its photo-sensitivity, or the material of layer 14 could be one which ultimately becomes either more stiff or less stiff on the application of light, heat, x-radiation, other radiation, particle bombardment, vibration, chemical treatment, work hardening, and/or other forms of energy, or by another stiffness modifying process or processes. The layer 14 may conveniently be made from certain of the materials listed by Nagano et al in U.S. Pat. No. 4,557,994, in column 3.

Those skilled in the art will understand that there are means other than a two-sided tape by which the composite member 10 can be mounted to a plate cylinder, for example the conventional clamp arrangement. It will also be understood that a plate cylinder is only one of several different kinds of support to which the composite member 10 can be mounted. For example, the support may consist of the platen used in a flatbed letterpress system, a curved or semi-cylindrical support, or other known configurations.

Figure 2:
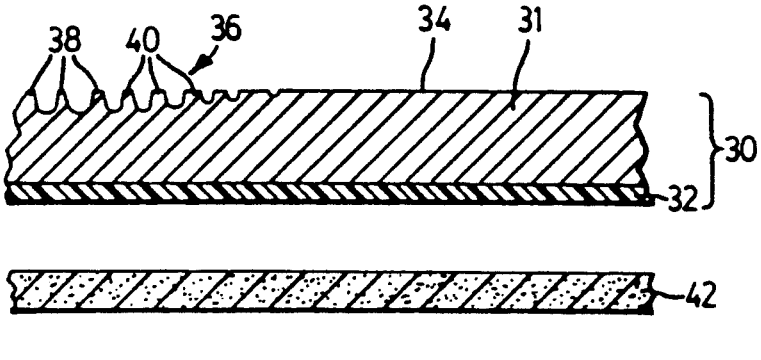
FIG. 2 is a sectional view through a second embodiment of this invention.

FIG. 2 shows an embodiment which has the form of a composite member 30 which includes a plate portion 31 and a flexible but non-stretchable layer 32 which may be of polyester or the like. These two layers are bonded together in the usual way.

The plate portion 31 incorporates a region identified by the numeral 34 which is unbroken and is intended to print a solid colour. The region 34 gradually merges into a region identified by the numeral 36, which contains spikes 38 having flat circular tops 40, which are intended to print the colored dots utilized in process colour printing. Note that the sizes of the tops 40 gradually decrease from right to left in FIG. 2.

In the embodiment of FIG. 2, the variations in stiffness are provided in the tape layer 42. This material would be selected as one which either increases or decreases in stiffness with the application of radiation or other energy, or work, or stiffness modifying process. The tape layer 42 may conveniently be made from certain of the photopolymers listed in column 3 of U.S. Pat. 4,557,994, Nagano et al. As can be seen in FIG. 2, the tape layer 42 is shown stippled under the region 34 to indicate relative stiffness. The stippling gradually fades toward and under the region 36, to indicate a progressively decreasing stiffness as the ink coverage decreases.

Figure 3:
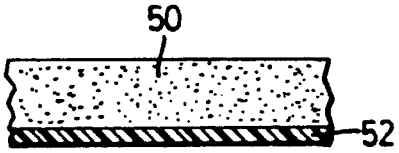
FIG. 3 is a sectional view through a third embodiment of this invention.

Attention is now directed to FIG. 3, which shows a plate with an upper layer 50 adhered to a flexible but non-stretchable layer 52, typically of polyester. Note that the material 50 is shown fully stippled, indicating that it has been made quite stiff. The portion shown in FIG. 3 is without dots or relieved areas, and thus is intended to print solid colour.

Figure 4:
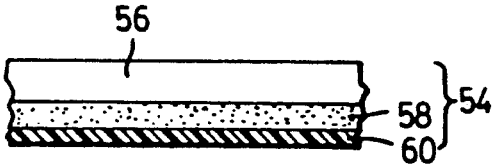
FIG. 4 is a sectional view through a fourth embodiment of this invention.

In the embodiment shown in FIG. 4, a composite member 54 is composed of an upper layer 56 and a lower layer 58. The lower layer 58 is secured to a flexible but non-stretchable layer 60, typically of polyester. In the FIG. 4 embodiment, as compared to that of FIG. 3, the stiffenable region is limited to the lower layer 58.

As with the first two embodiments, the embodiments of FIGS. 3 and 4 are such as to develop differential stiffness upon exposure to radiation or other energy or work or stiffness modifying process. In the case of the FIG. 3 embodiment, the same polymer or other material responds to energy or work or other process to change its relative stiffness and its relative capability to be etched. For the embodiment of FIG. 4, the variable stiffness is limited to the layer 58, while the upper layer 56 is intended to be relieved.

It is conceivable that, with any of the embodiments shown in the FIGURES, two or more exposures or procedures may have to be carried out. For example, the material of the plate portion 11 in FIG. 1 may be prepared using light of a certain wavelength, whereas the layer 14 may respond to light of a different wavelength. Furthermore, the two procedures or exposures may be carried out on the respective layers when they are separated, or when they are together.

It is important to realize that an exact proportionality between the stiffness factor and the degree of ink coverage may not represent the ideal construction. As a general rule, the less inked areas will correspond to a lower stiffness and the more inked areas will correspond to greater stiffness, however there are certain peculiarities in the printing process itself which may require something other than true proportionality. Also, there is a possibility that the provision of "stepped" stiffness regions will be not only acceptable but preferable.

Figure 5:
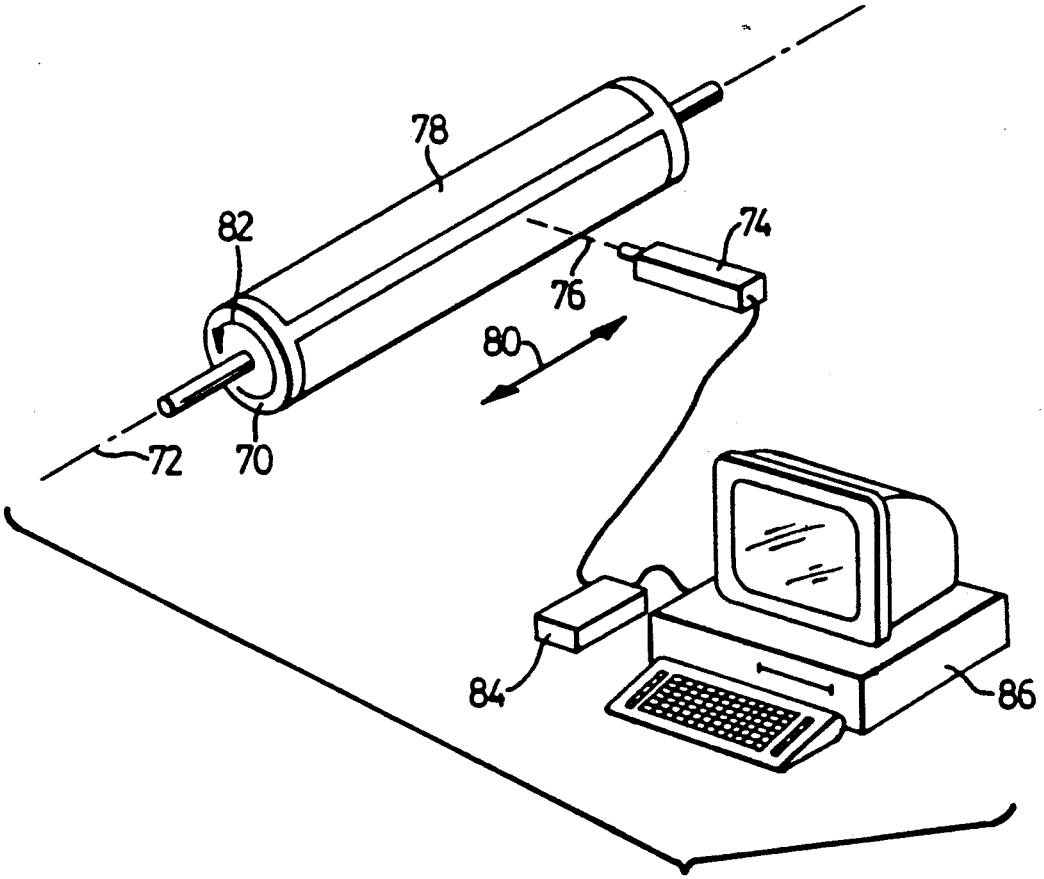
FIG. 5 is a schematic view showing the use of a laser to carry out this invention.

Attention is now directed to FIG. 5, which shows in schematic form an assembly of components adapted to carry out this invention.

In FIG. 5 is shown a mounting roll 70 adapted to rotate about an axis represented by the axial line 72. Means are provided for rotating the mounting roll 70 incrementally, in synchronism with the longitudinal sliding movement of a laser 74 adapted to produce a beam 76 of laser light which falls against the mounting roll 70. Secured around the periphery of the mounting roll 70 is a sheet of material 78 which is capable of photopolymerization, whereby it becomes more or less stiff depending upon the intensity and duration of the laser beam 76 at any given location on the sheet 78. The two-headed arrow 80 represents the concept that the laser 74 runs back and forth longitudinally with respect to the mounting roll 70, and that between each pair of sequential passes, the mounting roll 70 indexes in one rotational direction, as indicated by the arrow 82.

The laser 74 is controlled through a modem 84 by a computer 86 or the like.

In order to carry out the invention, the computer 86 turns the laser 74 into a "smart-laser", in the sense that the information stored in the computer and which directs the changes in the intensity of the laser beam 76 as the laser 74 traverses the length of the mounting roll 70, is able to determine the degree of coverage over any given area of the sheet 78. For example, if there is a region which is to print solid (for the color concerned), the computer would recognize this "solid" area, and in order to supply an increased or enhanced stiffness at that area, the computer would increase the intensity of the laser beam 76 as it traversed the area in question. Conversely, for an area of less coverage, i.e. highlight dots, the computer would control the laser so that the intensity of the beam 76 was diminished, thereby producing less stiffness over such an area. The variation in stiffness would be superimposed on the other function of the laser, namely to prepare the plate for the "relief" operation, by falling on locations that are to print and skipping locations that are not to print. In the conventional four-colour separation process, the laser beam 76 tends to be an intermittent beam, except over solid areas of coverage. More specifically, wherever the beam falls against the sheet 78 there is produced a small region (the size of the laser beam) which will not be eroded or eaten away in the subsequent processing step. Wherever the laser does not strike, the material of the sheet later undergoes material removal (relief). In the typical highlight regions, having dots of various sizes, the laser beam would be intermittent, whereas in the regions of solid ink coverage the laser beam would remain on throughout its traverse of that region. In accordance with this invention, one programs the computer 86 to recognize regions of non-intermittent laser action, and to increase the intensity of the laser during passes over such solid-printing regions.

It will be understood that, although the mounting roll 70 is shown in isolation in FIG. 5, in actual fact it would be housed within a compartment adapted to keep out any light other than the laser beam 76.

While four embodiments of this invention have been illustrated in the accompanying drawings and described hereinabove, it will be evident to those skilled in the art that changes and modifications may be made therefrom, without departing from the essence of this invention, as set forth in the appended claims.

The embodiments of the invention in which an exclusive property or privilege is claimed are defined as follows:

1. For use in a raised image printing process employing a plate support, an improved plate construction comprising:

a flexible plate portion having an upper printing surface for printing an image on a substrate, the image including areas of greater ink coverage and areas of less ink coverage, and means incorporated integrally into the plate portion for providing graduated regions of greater and less resistance to deformation below said upper printing surface, said means affecting the degree to which the surface is urged against the substrate with greater resistance to deformation occurring under image areas of greater ink coverage, and less resistance to deformation occurring under areas of lesser ink coverage, the plate portion having a uniform thickness, whereby said upper printing surface is uniformly spaced above the plate support.

2. A method of printing using a raised image printing process, the method comprising the steps:

providing a support surface;

providing a plate portion to said support surface such that said upper printing surface is at a uniform spacing from said support surface;

providing graduated regions of differing resistance to deformation integrally within said plate portion without altering said uniform spacing, such that a greater degree of resistance to deformation is provided under image areas of greater ink coverage, and lesser degree of resistance to deformation is provided under image areas of lesser ink coverage; and printing an image utilizing said upper printing surface.

3. The method claimed in claim 2, in which the step of providing regions of differing resistance to deformation is carried out such that the resistance to deformation under the various areas of ink coverage is substantially proportional to the degree of ink coverage in such areas.

4. The method claimed in claim 2, in which the regions of differing resistance to deformation are created by causing a beam of focused energy to fall on a sheet of photo-polymerizable material, while the beam moves with respect to said sheet, the material being such as to develop greater resistance to deformation when struck by a higher intensity beam, and lesser resistance to deformation when struck by a lower intensity beam, the intensity of the beam being controlled such that, when it is traversing a region intended to print substantially solid, its intensity is greater than when it is traversing a region intended to print less than solid.

5. The method claimed in claim 4, in which the beam of focused energy is a laser beam.

* * * * *